United States Patent [19]

Bohn et al.

[11] 4,359,705

[45] Nov. 16, 1982

[54] DEFLECTION UNIT FOR CATHODE RAY TUBES

[75] Inventors: Josef Bohn, Rheinhausen; Joachim Lerch, Eggenstein; Franz Troltsch, Stutensee, all of Fed. Rep. of Germany

[73] Assignee: Siemens Aktiengesellschaft, Berlin and Munich, Fed. Rep. of Germany

[21] Appl. No.: 193,740

[22] Filed: Oct. 3, 1980

[30] Foreign Application Priority Data

Oct. 9, 1979 [DE] Fed. Rep. of Germany ..... 2940931

[51] Int. Cl.[3] ..... H01F 7/00

[52] U.S. Cl. ..... 335/213; 335/210

[58] Field of Search ..... 335/213, 212, 210

[56] References Cited

U.S. PATENT DOCUMENTS 2,639,314 5/1953 Christiana et al. ..... 335/213
3,601,731 8/1971 Bryan ..... 335/213
3,801,941 4/1974 Phillips ..... 335/213
4,260,974 4/1981 Nelle ..... 335/213

FOREIGN PATENT DOCUMENTS 1416935 12/1975 United Kingdom ..... 335/212

*Primary Examiner*—Harold Broome
*Attorney, Agent, or Firm*—Kenyon and Kenyon

[57] ABSTRACT

A deflection unit for a cathode ray tube, the deflection unit having saddle-shape sets of coils which are wound in slots which extend along the inside of a one-piece coil form. The coil form is flared so as to conform to the outer surface of the envelope of a cathode ray tube. The coils are wound so as to be interleaved in respective slots of the coil form thereby ensuring that the two sets of coils have substantially equal diameters with respect to a central longitudinal axis of the coil form. In further embodiments, apparatus is provided for rotatably affixing the deflection unit to the cathode ray tube so as to permit rotation of the cathode ray tube image. Such rotation may be achieved by an electric motor.

12 Claims, 6 Drawing Figures

DEFLECTION UNIT FOR CATHODE RAY TUBES

BACKGROUND OF THE INVENTION

This invention relates generally to electron beams deflection systems for cathode ray tubes, and more particularly, to a magnetic deflection system having coil windings disposed in slots of a coil form.

German patent reference DE-OS No. 28 07 978 teaches that it is difficult to achieve a suitable shape for a magnetic field produced by the windings of a cathode ray tube (CRT) deflection yoke of the type which conforms to the flared shape of the CRT envelope. The reference further states that the higher sensitivity of saddle-shaped coils with respect to toroid coils renders the production of suitable field shapes particularly difficult. Accordingly, the designers of CRT equipment have heretofore encountered difficult design choices. On the one hand, it is desirable to extend the portion of the electron beam axis throughout which the electron beam of the CRT is under the influence of the magnetic deflection field so as to achieve improved deflection sensitivity. However, such a technique would require either a lengthening of the neck of the envelope, which is generally undesirable, or the mounting of the deflection coils partially around the flared portion of the envelope. It is a further problem, however, that the mounting of the deflection coils over the flared portion of the envelope increases the distance between the coils and the electron beam, thereby diminishing the degree of influence of the magnetic field over the electron beam.

The prior art has thrust at the problem of decreased sensitivity resulting from increased distance between the deflection coils and the electron beam by utilizing saddle-shaped coils. As indicated, although such coils have greater sensitivity than toroid coils, the production of a suitable magnetic field shape is difficult to achieve. In one prior art arrangement, saddle-shaped coils for one dimension of deflection are disposed in contact with the CRT envelope. The coils for the second dimension of deflection are disposed over the first set of coils, either as toroidal or as saddle-shaped coils. Accordingly, the second set of coils is disposed further from the electron beam than the first set of coils, thereby requiring much greater amounts of electric deflection power.

It is, therefore, an object of this invention to provide a deflection unit, which provides to the CRT a large modulation transfer function.

It is a further object of this invention to provide a deflection unit which is efficient in its use of electric deflection power and provides a relatively small amount of astigmatic distortion.

It is another object of this invention to provide a magnetic deflection system wherein the vertical and horizontal deflection coils have equal and minimum diameters around the electron beam axis.

SUMMARY OF THE INVENTION

The foregoing and other objects are achieved by this invention which provides a deflection unit for a CRT; the unit having two saddle-shaped sets of coils, each set being associated with one direction of deflection; and the coil windings being disposed in slots on the inside of a coil form. The coil form is flared so as to conform to the shape of the envelope of the CRT. The sets of coils are interleaved within the slots of the coil form so as to have substantially equal effective diameters with respect to the axis of the electron beam.

In one embodiment of the invention, the coil form is constructed in one piece having slots and head chambers for containing two sets of deflection coils, for the horizontal and vertical directions. Such a form permits the coils to be wound thereon by automatic equipment, without the need for additional adjustment. Each set of coils which is associated with a respective direction of deflection consists of two symmetrically arranged windings. The windings for producing vertical deflection of the electron beam are advantageously arranged symmetrically with respect to an axial-vertical plane. Similarly, the slots in the coil form in which the horizontal deflection coils are disposed are arranged symmetrically with respect to a horizontal-axial plane. Thus, the horizontal and vertical deflection coils are mounted on the same coil form, but are orthogonally oriented with respect to one another.

The horizontal and vertical deflection coils are wound on the coil form so as to be interleaved in such a manner that the slots which lie between the horizontal and vertical axial planes contain alternatingly disposed turns of the horizontal and vertical deflection coils. Ring-shaped coil head chambers are perpendicularly disposed at the ends of the slots, and surrounding the perimeters of both ends of the coil form. The number of turns in the coil heads varies over the circumference of the ends of the coil form. Accordingly, in one embodiment of the invention, the coil head chambers which are disposed between the slots and around the perimeter of the ends of the coil form have respective depths which advantageously differ from one another so that the coil head chambers are uniformly filled with windings.

The specific illustrative embodiment of the deflection unit comprising a coil form upon which are disposed the deflection coils is positioned concentrically about the neck of the CRT envelope so that the flared portion of the deflection unit adjoins the flared portion of the CRT envelope, thereby insuring that the deflection unit is disposed in a fixed relationship with respect to the electrode system of the CRT. Such an arrangement insures that the deflection unit is properly positioned with respect to the axis of the CRT envelope. Moreover, the mounted deflection coils are rotatable about the axis of the CRT envelope. Such rotatability is desirable in embodiments of the invention which are used in medical television and permit the displayed television picture to be rotated on the screen. This avoids the need for rotating the video camera or the patient. In one embodiment of the invention, rotatability is achieved by rotatably mounting the coil form on a rotatable element which is affixed to the CRT. Electrical continuity between the coils of the deflection unit and external control circuitry is achieved by the combination of slip rings and sliding contacts. In one embodiment, the slip rings are affixed so as to rotate with the coil form, and the sliding contacts are fastened to a mounting system. In a further embodiment, motorized means may be provided for rotating the coil form with respect to the envelope of the CRT. Cam operated switches may be provided to discontinue the conduction of electrical energy to the motor when the yoke and picture have achieved a predetermined rotational orientation.

BRIEF DESCRIPTION OF THE DRAWINGS

Comprehension of the invention is facilitated by reading the following detailed description in conjunction with the annexed drawings in which.

DETAILED DESCRIPTION

Figure 1:
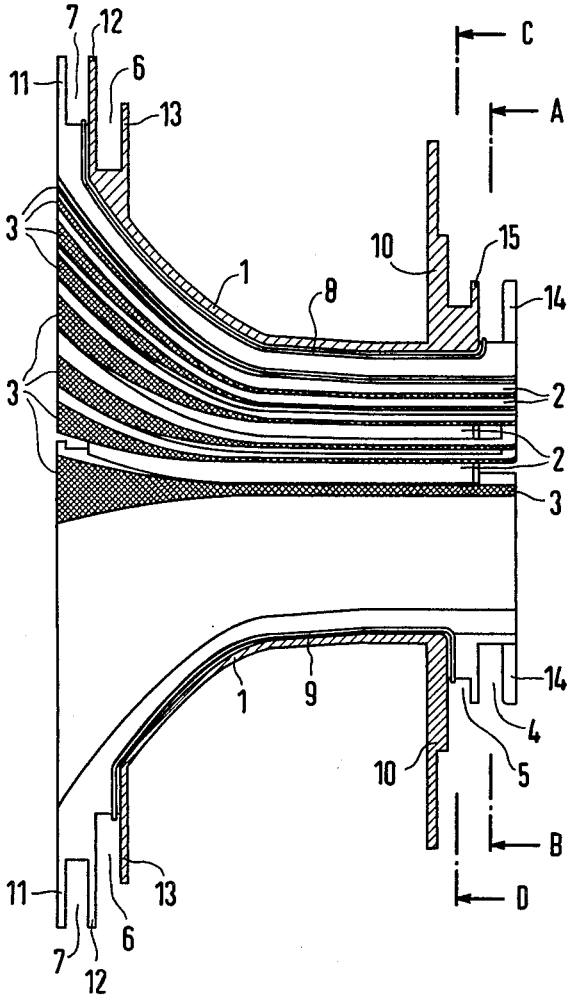
FIG. 1 is a cross-sectional representation of a coil form according to the principles of the invention.

FIG. 1 shows a cross-section view of a coil form 1 which has several slots 2 on its inside. In order to preserve the clarity of the drawing, only the slots on the upper half of the coil form are shown. Slots 2 are separated from one another by several ribs 3 which are shown shaded in the drawing. In this embodiment, coil form 1 is flared in the form of a horn so as to correspond to the shape of a CRT envelope. When the form is mounted on a CRT, ribs 3 are in contact with the CRT envelope. As will be described below, vertical and horizontal deflection coils (not shown in this figure) are wound on the coil form so as to be disposed in slots 2. The coil form is provided with a plurality of coil head chambers 4, 5, 6, and 7 which are formed from chamber walls 10, 11, 12, 13, 14, and 15. Wall 10 is shown in this embodiment to have a greater diameter than its associated chamber walls 15 and 14, so as to permit a yoke ring to be mounted thereon, as will be explained hereinbelow.

The figure shows two winding turns 8 and 9 which are associated with one each of the horizontal and vertical deflection coils, respectively. Turn 8 which is illustratively associated with one of two horizontal deflection coils extends out of the plane of the figure at chamber 7, runs along a longitudinal slot, and into the plane of the paper at coil chambers 4. The other turns (not shown) of the horizontal deflection coils are correspondingly disposed in associated slot 2. Turn 9 which is associated with one of two vertical deflection coils extends out of the plane of the paper at chamber 6, runs along a slot 2, and reenters the plane of the paper at chamber 5. It is apparent from the figure that turns 8 and 9 are equidistant from a longitudinal central axis (not specifically shown) of the coil form, and therefore the completed coils have substantially equal diameters.

Figure 2:
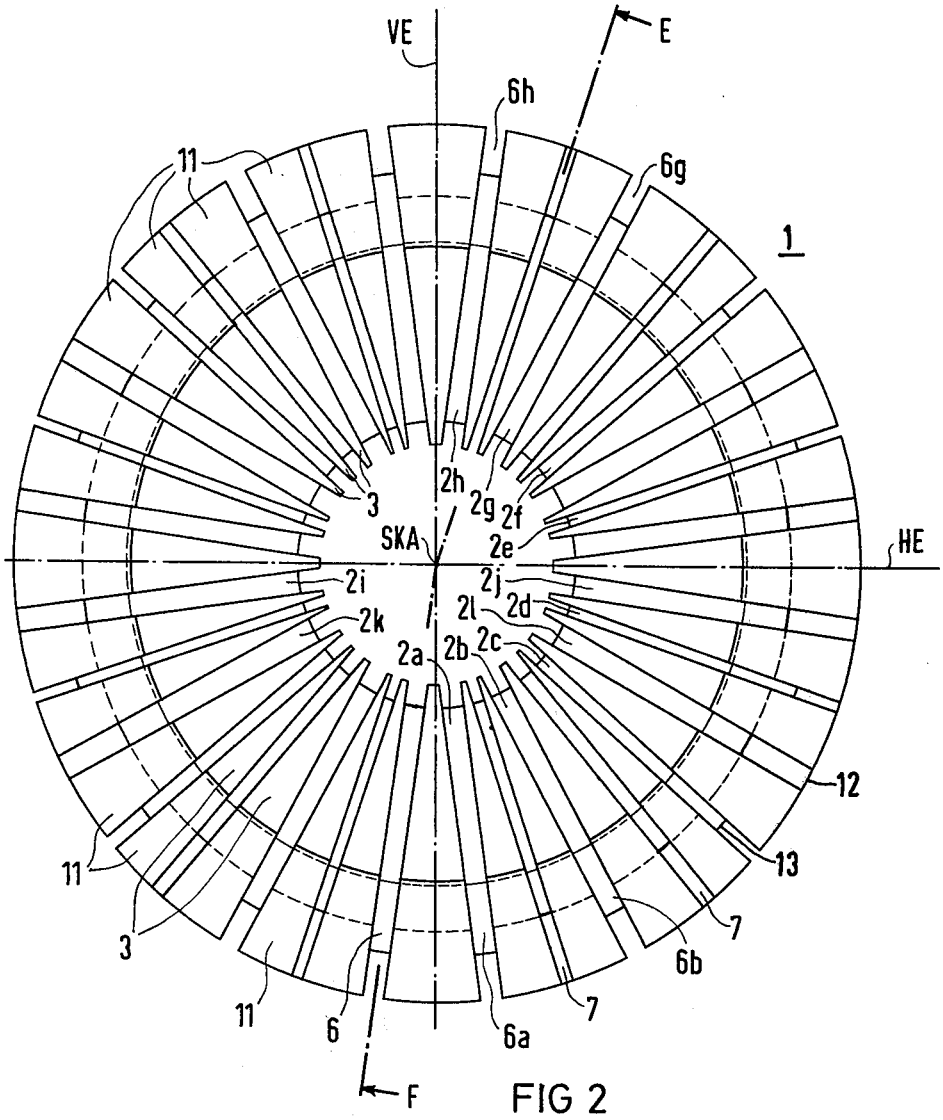
FIG. 2 is a front plan view of the coil form.

FIG. 2 shows a frontal view of coil form 1, and shows the cross-section of section planes E and F along which the cross-sectional representation of FIG. 1 is presented. Longitudinal slots 2 are shown, and are provided with respective lower case letter designations which will facilitate the description, hereinbelow. The figure further shows the end faces of ribs 3 which merge into a front wall 11 of coil head chamber 7. Front wall 11 is shown to be discontinuous so as to permit communication between coil head chambers 7 and the slots 2. As can be seen from FIG. 1, predetermined ones of slots 2 which contain turns of wires to coil head chamber 7 run under a chamber 6, and therefore do not communicate with chamber 6. However, other ones of slots 2 which carry wires to chamber 6, such as turn 9 in FIG. 1, may communicate with either chambers 6 or 7. Chambers 6 and 7 are separated from each other by a partition wall 12. Partition wall 12 is visible through some of the slots in FIG. 2. A chamber wall 13, which is shown in cross-section in FIG. 1, is also visible through other slots in FIG. 2.

FIG. 2 does not show any coil windings in order to preserve the clarity of the drawing. For purposes of illustration, however, a hypothetical coil turn (not shown) lying in slot 2*a* will run to a point 6*a* in front coil head chamber 6. At this point, the coil winding wire would be bent to the right at substantially a right angle, so as to be disposed in chamber 6 for approximately a semi-circle. The winding would enter slot 2*h* at a point 6*h*. In this example, the coil wire would run to the end of slot 2*h* and into rear coil head chamber 5, wherein it is returned to the rear of slot 2*a*. Such a winding will be shown in greater detail hereinbelow with respect to FIG. 4. Similarly, a corresponding winding can be formed by placing the wire in a slot 2*b* to a point 6*b*, at which point the wire is turned to the right so as to follow a semi-circle through coil head chamber 6 to a point 6*g* where the wire would enter slot 2*g*. The wire is returned to slot 2*b* by means of rear coil head chamber 5. Additional corresponding windings are disposed in slots 2*c*, 2*f*, 2*d* and 2*e*. All such windings are wound in series, and thereby form a vertical deflection coil. As previously indicated, the slots vary in depth with respect to one another so as to conform to the number of turns which they are expected to hold. A second vertical deflection coil (not shown) is symmetrical to the coil just described with respect to an axial plane VE which extends in the vertical direction. Both such symmetrical coils can be advantageously connected in series or parallel to form the set of coils for the vertical deflection.

In a fashion similar to that described hereinabove, horizontal deflection coils (not shown) are disposed on the coil form so as to be orthogonal to the vertical deflection coils and symmetrical with respect to an axial plane HE which extends in the direction of the horizontal deflection. Illustratively, one winding of the lower coil would lie in slots 2*i* and 2*j*. A further such winding would lie in slots 2*k* and 2*l*. In practice, the horizontal and vertical deflection coils are wound so as to be interleaved. The slots disposed between the axial planes VE and HE are alternatingly wound with horizontal and vertical deflection turns. Only those slots which are disposed adjacent to the axial planes VE and HE contain windings of coils associated with only one direction of deflection. Thus, the slots adjacent to axial plane VE contain only vertical deflection coil windings; and the slots adjacent to horizontal axial plane HE contain only horizontal deflection coil windings.

Figure 3:
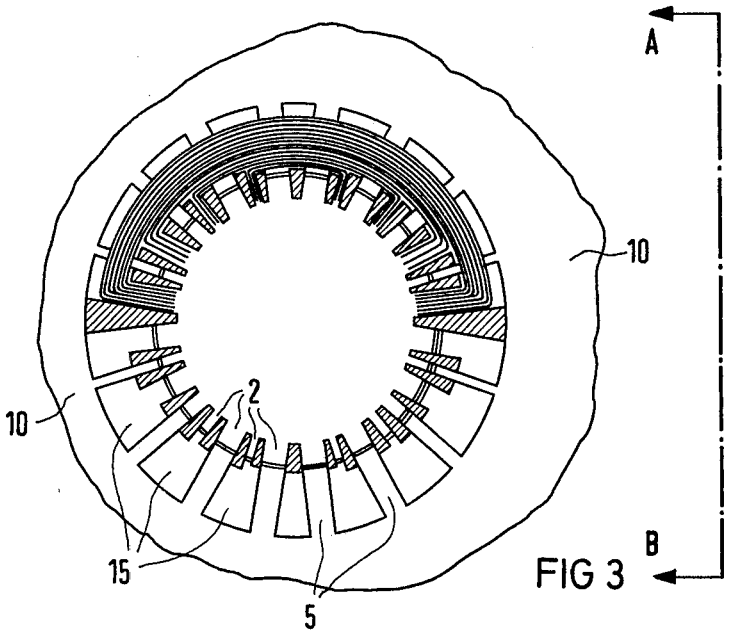
FIG. 3 is a cross-sectional representation of the rear portion of the coil form showing horizontal deflection coils disposed in the rear coil head chambers.

FIG. 3 shows a cross-section view through rear coil head chamber 4 taken along plane A—B of FIG. 1 and shows the rear coil of the upper horizontal deflection coil. For purposes of preserving the clarity of the drawing, the lower horizontal deflection coil is not shown. In this embodiment of the invention, the shown upper horizontal deflection coil has its front coil heads disposed in front coin head chamber 7. (Shown in FIGS. 1 and 2.) FIG. 3 shows a fragmented view of front wall 10 of coil head chamber 5. Since slots which communicate with chamber 5 are also in communication with chamber 4 and its walls 14 and 15 (see FIG. 1), chamber 5 is visible through the openings in wall 15. Accordingly, in this embodiment the vertical deflection coils must be wound prior to the winding of the horizontal deflection coils.

Figure 4:
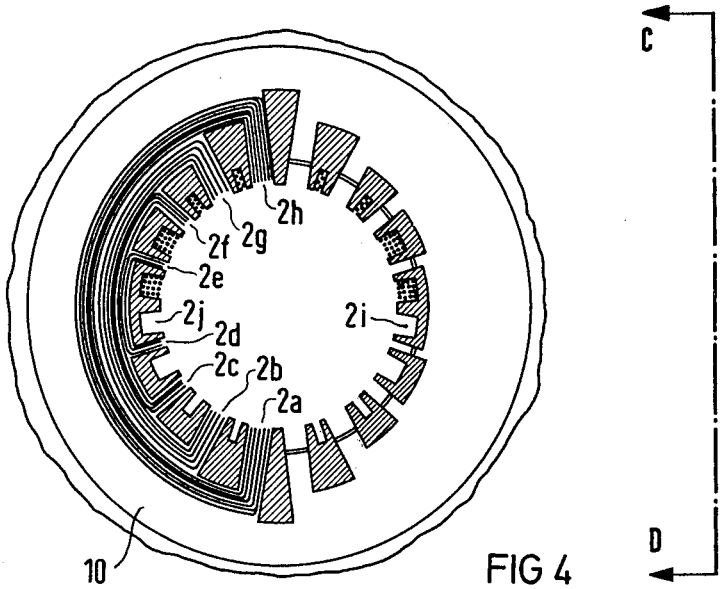
FIG. 4 is a cross-sectional representation of the rear portion of the coil form showing vertical deflection coils.

FIG. 4 shows a cross-section view along plane C—D of FIG. 1, and shows coil head chamber 5 and the left vertical deflection coil. The figure shows the continuity of the windings contained in slots 2*a* and 2*h*; 2*b* and 2*g*; 2*c* and 2*f*; and 2*d* and 2*e*. It is further visible from the drawing that the actual number of winding turns disposed in coil head chamber 5 varies over the circumference. Illustratively, more turns lie over slots 2*e* and 2*d* than over slots 2*b* and 2*g*. Such a variation in the number of turns over the circumference of the coil head chamber is compensated by providing a correspondingly varying depth. As shown in the figure, coil head chamber 5 is deeper immediately over slot 2*j* than over slot 2*c*. This variable depth technique for the head chambers is applied in this embodiment of the invention to the vertical and horizontal deflection coils, and ensures that the coil heads have a uniform distribution of coil windings so as to produce constant magnetic field structures.

Figure 5:
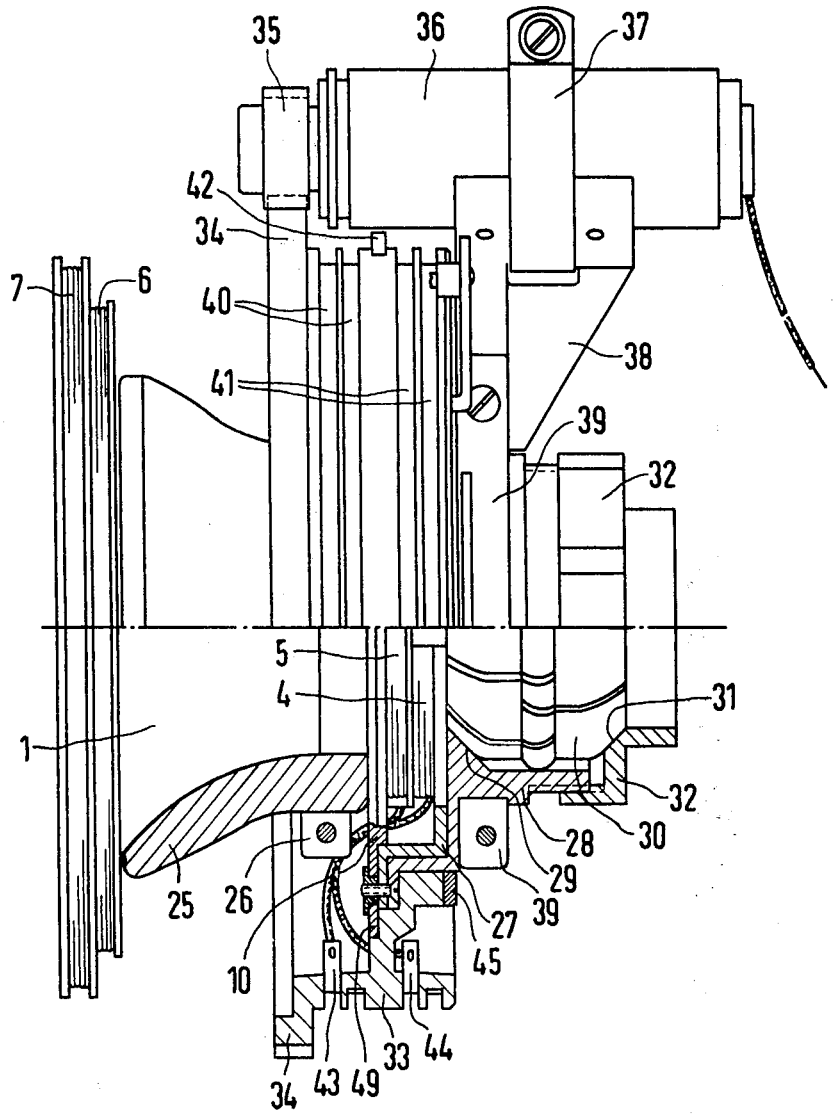
FIG. 5 is a side view of the invention, partly in plan form and partly in cross-section, having mechanism for rotating the coil form.
Figure 6:
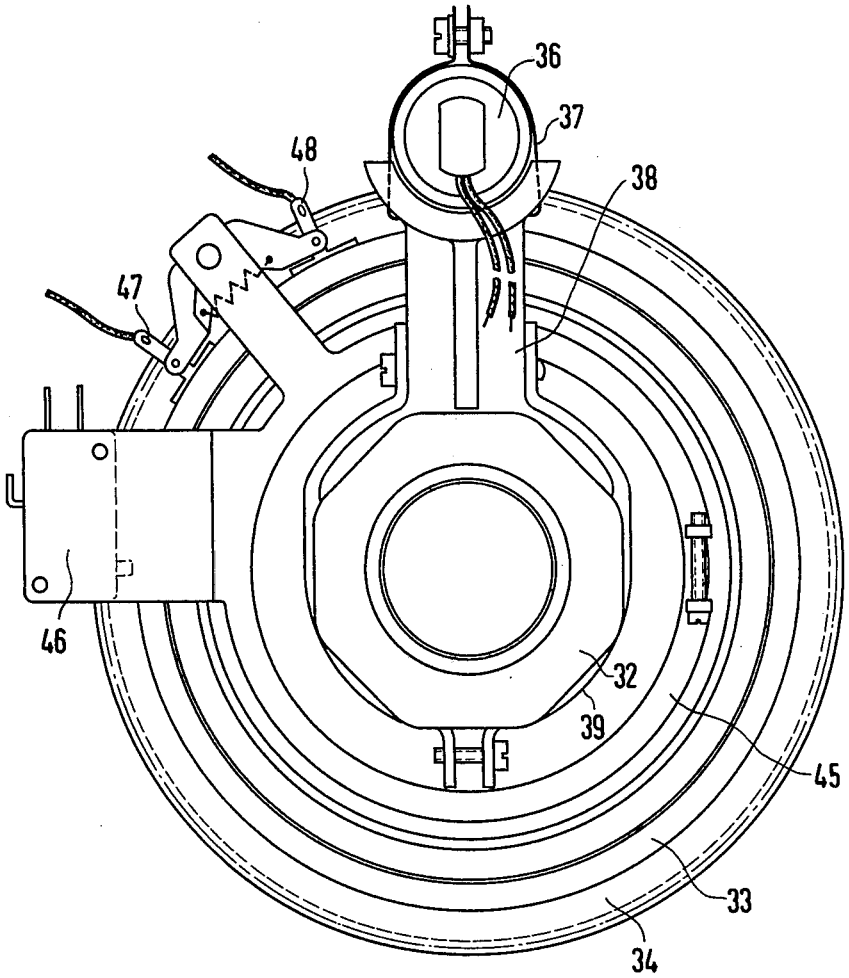
FIG. 6 is a rear plan view of a motorized embodiment of the invention.

FIGS. 5 and 6 show side and rear views, respectively, of an embodiment of the invention in which the coil form and the deflection coils are rotatable with respect to the envelope of the CRT. Horizontal and vertical deflection coils which are mounted in a coil form as shown in FIGS. 1 through 4 hereinabove are particularly suitable for rotatable embodiments because the coil form protects the coils from damage during rotation. In FIG. 5, coil form 1 is shown with coil head chambers 4, 5, 6, and 7. A clamp 26 fastens a yoke ring 25 which consists of ferromagnetic material to coil form 1. Front wall 10 of coil head chamber 5, which is adapted to serve as a mounting flange is mechanically coupled via bearing ring 27 to a clamping ring cage 28. A nut 32 is threadedly engaged with clamping ring cage 28. Clamping ring cage 28 contains within it a double purpose clamping ring 30 which contains clamping prods which are forced against bevelled inside surfaces 29 and 31 of cage 28 and nut 32. The inside diameter of clamping ring 30 corresponds to the outer diameter of the neck of the CRT envelope, so that tightening of nut 32 causes clamping ring 30 to be tightened against the neck of the CRT envelope. Additionally, clamping ring 30 centers and aligns the deflection unit with respect to the CRT envelope neck and its electrode system. Nut 32 is provided at its rear with an extension for mounting permanent magnets which are used to correct deviations between the axes of the deflection unit and the electrode of the CRT. Also, additional mounting brackets may be provided near the front portion of the deflection unit for mounting additional permanent magnets.

Bearing ring 27 may be omitted in embodiments which do not rotate. However, in rotating embodiments, mounting flange 10 must be released and made rotatable by releasing a screw 49 disposed between clamping ring cage 28 and mounting flange 10. In this embodiment, mounting flange 10 is affixed to a transfer member 33 by means of bearing ring 27. A holder 45 is clamped onto clamping ring cage 28. The arrangement of transfer element 33, bearing ring 27 and the deflection can be rotated relative to the mount consisting of clamping ring cage 28, clamping ring 30, and nut 32.

A motor 36 is fastened by a clamp 37 to a motor carrier 38, and is used to rotate the deflection unit. Motor carrier 38 is clamped to clamping ring cage 28 by a clamp 39. Transfer element 33 is provided with a gear toothed front portion 34 which meshes with a pinion gear 35 mounted on the shaft of motor 36. In order to permit continuous revolutions of the deflection unit without the need to reverse the direction of rotation, electrical connections are made to the coils by slip rings 40 and 41 which are provided with sodering lugs 43 and 44. Two additional sodering lugs are not shown in the figure. Sliding contacts 47 and 48 in FIG. 6 provide electrical energy to the vertical and horizontal deflection coils. Sliding contacts 47 and 48 are fastened to a mount 45.

Cam switch 46 which is actuated by a cam 42 on transfer member 33 is provided to achieve a predetermined orientation of the deflection unit with respect to the CRT. During rotation of the deflection unit, cam 42 actuates switch 46 so as to discontinue current to motor 36. Upon the interruption of motor current, the deflection remains in the predetermined position.

Although the inventive concept disclosed herein has been described in terms of specific embodiments and applications, persons skilled in the pertinent art can generate additional embodiments without departing from the spirit or exceeding the scope of the invention. The drawings and descriptions are merely illustrative embodiments proferred to facilitate comprehension of the invention and should not be construed to limit the scope thereof.

What is claimed is:

1. A deflection unit for a cathode ray tube having first and second sets of saddle-shaped coils which are respectively associated with first and second directions of electron beam deflection, the coils having windings which run in slots which extend along the inside of a coil form which is shaped so as to flare outwardly with respect to a first direction along a central longitudinal axis, the coil form further having first and second coil head chambers for communicating with the slots at respective first and second ends, the deflection unit being characterized in that the coil form is constructed in one piece, and the first and second sets of coils are wound so as to be interleaved in respective ones of the slots.

2. The deflection unit of claim 1 wherein the slots are arranged so as to be symmetrical about the central longitudinal axis of the coil form.

3. The deflection unit of claim 2 wherein the slots are arranged symmetrically with respect to first and second axial planes which intersect at the longitudinal central axis and which extend along the first and second directions of electron beam deflection.

4. The deflection unit of claim 3 wherein the slots which are disposed between said first and second axial planes alternatingly contain winding turns of the sets of coils associated with the first and second directions of electron beam deflection.

5. The deflection unit of claim 1 wherein the slots are each provided with first and second outer coil head chambers and first and second inner coil head chambers at the respective first and second ends of the slots, the turns of the first set of coils being disposed in the first and second inner coil head chambers, and the turns of the second set of coils being disposed in the first and second outer coil head chambers, the slots which contain the turns of the first set of coils leading to the first and second inner coil head chambers being in communication with the first and second outer coil head chambers.

6. The deflection unit of claim 6 wherein at least said second outer and second inner coil head chambers have depths which correspond to the distribution of winding turns of the coil heads.

7. The deflection unit of claim 1 wherein the coil form is provided with a mounting flange near the second inner coil head chamber, said mounting flange being arranged substantially perpendicular to, and concentrically about, the longitudinal central axis, said mounting flange being rotatably connected to a mount member having a double clamping ring, the inside diameter of said double clamping ring corresponding to a preselected portion of the envelope of the cathode ray tube.

8. The deflection unit of claim 7 wherein the coil form is affixed to said preselected portion of the cathode ray tube.

9. The deflection unit of claim 8 wherein a transfer member is rotatably supported on said mount member, the first and second sets of coils being in electrical contact with at least one sliding contact which is mechanically connected to said mounting flange.

10. The deflection unit of claim 9 wherein there is further provided a slip ring in electrical contact with said sliding contact, said slip ring being attached to said transfer element and concentrically disposed about the longitudinal central axis of the coil form.

11. The deflection unit of claim 9 or 10 wherein said transfer element is provided with a gear which is meshedly engaged with a pinion which is driven by a motor so as to rotate the deflection unit.

12. The deflection unit of claim 11 wherein there is further provided means for interrupting electrical power to said motor when the deflection unit has been rotated to a predetermined orientation.

* * * * *